United States Patent [19]

Watanabe

[11] Patent Number: 4,733,765

[45] Date of Patent: Mar. 29, 1988

[54] CASH HANDLING MACHINE FOR HANDLING MIXTURES OF NOTES AND COINS INTRODUCED TOGETHER

[75] Inventor: Yoshihiro Watanabe, Fujisawa, Japan

[73] Assignee: Kabushiki Kaisha Toshiba, Kawasaki, Japan

[21] Appl. No.: 929,773

[22] Filed: Nov. 13, 1986

[30] Foreign Application Priority Data

Nov. 14, 1985 [JP] Japan ..... 60-255286
May 22, 1986 [JP] Japan ..... 61-117953

[51] Int. Cl.[4] ..... G07F 7/04; B07C 5/02

[52] U.S. Cl. ..... 194/206; 235/379; 209/534; 453/3; 221/12; 271/3.1; 271/9; 271/4; 271/126; 271/160

[58] Field of Search ..... 194/206, 207, 350, 351; 235/379, 380, 381; 209/534; 232/15, 16, 7; 453/63, 3; 221/12, 210, 259; 271/3.1, 4, 6, 9, 110, 111, 117, 126, 127, 122, 149, 160, 198

[56] References Cited

U.S. PATENT DOCUMENTS

| | | | |
|---|---|---|---|
| 3,667,485 | 6/1972 | Sesko | 194/207 |
| 4,023,011 | 5/1977 | Nakajima et al. | 194/207 X |
| 4,372,478 | 2/1983 | Gomez et al. | 232/15 X |
| 4,473,157 | 9/1984 | Hirose et al. | 271/4 X |
| 4,542,287 | 9/1985 | Watanabe | 235/379 |
| 4,549,661 | 10/1985 | Morishita et al. | 209/534 |
| 4,558,712 | 12/1985 | Sentoku et al. | 453/3 |
| 4,571,489 | 2/1986 | Watanabe | 235/379 |
| 4,602,332 | 7/1986 | Hirose et al. | 194/206 X |

FOREIGN PATENT DOCUMENTS

| | | | |
|---|---|---|---|
| 0012695 | 2/1978 | Japan | 209/534 |
| 0136736 | 10/1981 | Japan | 235/379 |
| 0075371 | 5/1982 | Japan | 235/379 |
| 0197963 | 11/1984 | Japan | 235/379 |

OTHER PUBLICATIONS

"Automatic Teller Machine with Loose Coin Depository", IBM Technical Disclosure Bulletin, vol. 28, No. 11, Apr. 1986, pp. 4749–4750.

*Primary Examiner*—Joseph J. Rolla
*Assistant Examiner*—Edward S. Ammeen
*Attorney, Agent, or Firm*—Cushman, Darby & Cushman

[57] ABSTRACT

A cash handling machine includes a housing having an aperture through which cash is put in, a bank note conveyor, a bank note sorter for sorting the bank notes conveyed by the bank note conveyor according to type of bank notes, a coin conveyor, and a coin sorter for sorting the coins conveyed by the coin conveyor according to type of coins. The machine has a single cash receiver for receiving both bank notes and coins put in through the aperture, a bank note feeder connected to the single cash receiver for taking out the bank notes from the single cash receiver and for feeding the bank notes to the bank note conveyor, and coin feeder connected to the single cash receiver for taking out the coins from the single cash receiver and for feeding the coins to the coin conveyor.

12 Claims, 10 Drawing Figures

CASH HANDLING MACHINE FOR HANDLING MIXTURES OF NOTES AND COINS INTRODUCED TOGETHER

BACKGROUND OF THE INVENTION.

1. Field of the Invention

The present invention relates to a cash handling machine such as an automatic transaction machine (subsequently referred to as ATM) operated by means of a cash card and the like, and in particular to such machine into which mixtures of bank notes and coins can be introduced together.

2. Description of the Prior Art

The most recent ATMs are multi-function machines capable of automatic coin handling and were developed to perform the complex function of paying from a simple bank note depositing/withdrawing machine.

These ATMs are provided at their front with one aperture for inserting coins and another aperture for bank notes, so that coins and bank notes are introduced separately.

With the above type of ATM, coins are frequently introduced into the aperture for bank notes. The aperture for introducing coins is, therefore, generally made narrow which makes it difficult to introduce bank notes into it. The aperture for bank notes generally must be able to accommodate bundles of bank notes. Also bank notes must be able to be both accepted by the ATM and issued by the ATM to the customer. Therefore, the aperture for bank notes must be made rather large to facilitate the manual gripping and taking out of money. Thus, when coins are inserted into the wrong aperture, the fact that they are rigid, thick and cannot bend well causes damage to internal components such as the belt and rollers constituting the bank note conveying means or the bank note thickness monitor, which constitutes a serious drawback.

SUMMARY OF THE INVENTION

In is an object of the present invention to provide a cash handling machine in which cash handling proceeds in a reliable manner without the possibility of damaging the bank note conveying means and its internal components.

According to one aspect of the present invention, there is provided a cash handling machine including a housing having an aperture through which cash is put in, a bank note conveying means, a bank note sorting means for sorting the bank notes conveyed by the bank note conveying means according to type of bank notes, coin conveying means, and a coin sorting means for sorting the coins conveyed by the coin conveying means according to type of coins. A single cash receiving means receives both bank notes and coins inserted through the aperture. A bank note feeding means, connected to the single cash receiving means, separates bank notes from the single cash receiving means and feeds the bank notes to the bank note conveying means. A coin feeding means, connected to the single cash receiving means, separates coins from the single cash receiving means and feeds the coins to the coin conveying means.

BRIEF DESCRIPTION OF THE DRAWINGS

These objects and advantages of this invention will become more apparent and more readily appreciated from the following detailed description of the presently preferred exemplary embodiments, taken in conjunction with the accompanying drawings of which:

FIGS. 7–10 show the another embodiment of a cash handling machine according to the present invention, in which:

FIG. 7 is a side view showing a cash receiving hopper;

FIG. 8 is a side view showing the taking-in operation of the cash receiving hopper;

FIG. 9 is a front view showing the cash receiving hopper; and

FIG. 10 is a block diagram showing the control system.

DETAILED DESCRIPTION OF THE PREFERRED EMBODIMENTS

One of the preferred embodiments of the present invention will be described with reference to the accompanying drawings.

Figure 1:
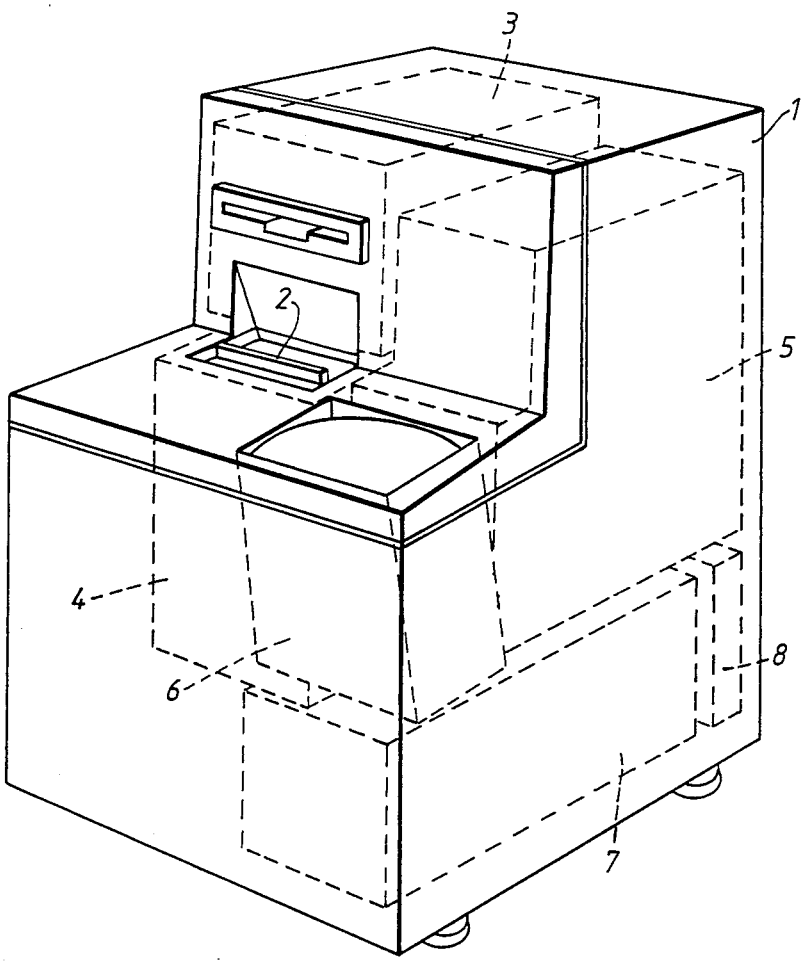
FIG. 1 is a perspective view showing a cash handling machine according to this invention.

FIG. 1 shows a cash handling machine. A housing 1 has at the front thereof an aperture 2 for introducing both coins and bank notes. Housing 1 contains in its interior a unit 3 for inserting chits, cards, pass books and the like and below unit 3 there is a bank note depositing/withdrawing unit 4. A coin circulating unit 5 is arranged in housing 1, parallel to unit 4. A CRT display 6 is located in front of unit 6. A power source control unit 7 and an internal operating panel 8 are installed underneath unit 5 and display 6.

Figure 2:
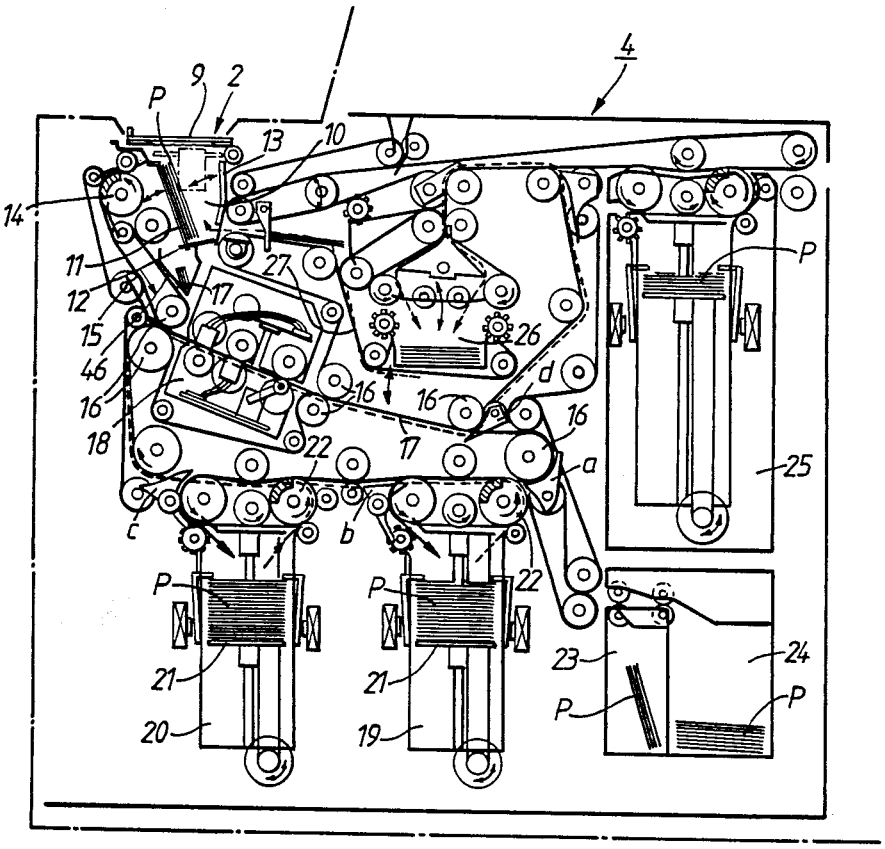
FIG. 2 is a side view showing the construction of the interior of the bank note sorting unit housed in the cash handling machine.

The construction of bank note depositing/withdrawing unit 4 is shown in FIG. 2. Reference number 9 denotes a shutter which opens/closes aperture 2. A cash receiving hopper 10 is installed below shutter 9. A supporting plate 11 which supports the bank notes P introduced into the machine in a standing state is installed at the bottom of cash receiving hopper 10 together with a bottom plate 12 which opens/closes the bottom of cash receiving hopper 10. A backup plate 13, arranged separately from and facing support plate 11, is freely rockable about its middle. The upper halves of bank notes P introduced into hopper 10, are pressed by the rocking of backup plate 13, acting as a feeding means, causing the notes to come into contact with feed roller 14. Rotation of feed roller 14 causes bank notes P to be removed one by one and fed to a bank note conveying means 15, bank note conveying means 15 comprises a plurality of rollers 16 and a conveyor belt 17, passing between rollers 16. During their passage along conveyor belt 17, bank notes P pass through an inspection unit 18 which causes the notes to be directed to a 10 dollar storage bin 19 and a 1 dollar storage bin 20. Lifts 21 are provided in bins 19 and 20 to raise 10 dollar and 1 dollar bank notes received by bins 19 and 20 so that they may make contact with discharging rollers 22 causing them to be taken out one by one. A reject storage bin 23 receives rejected bank notes and a recovery storage bin 24 collects bank notes P remaining in cash receiving hopper 10. A receiving storage bin 25 is used for loading and close inspection, and temporary accumulating storage bin 26 is used for turning over bank notes P.

When bank notes P are deposited, shutter 9 is open enabling bank notes P to be introduced into cash receiving hopper 10. Backup plate 13 presses against the upper half of these bank notes P causing them to come into contact with feed roller 14, the rotation of which causes them to be taken out upwards one at a time. They are then forwarded to inspection unit 18 by conveyor belt 17 in the direction indicated by the solid arrow. At inspection unit 18, bank notes P are examined. 10 dollar notes are then forwarded to 10 dollar storage bin 19 via first and second gates a and b, and 1 dollar notes are forwarded to 1 dollar storage bin 20 via first and third gates a and c.

When money is withdrawn, 10 dollar notes are raised in storage bin 19 by lift 21, causing them to come into contact with discharging roller 22 and the corresponding operation takes place in storage bin 20 with 1 dollar notes. Rotation of discharging rollers 22 causes bank notes to be taken out one by one and to be fed to inspection unit 18 via first and third gates a and c in the direction indicated by the broken line. In inspection unit 18, the type of note is verified. The notes are then forwarded via a fourth gate d to temporary storage bin 26, used for turning over the bank notes, forwarded to hopper 10 via a discharging belt 27 and discharged from there. Discharged bank notes P can be taken out from cash receiving hopper 10 with shutter 9 open by the customer.

Figure 3:
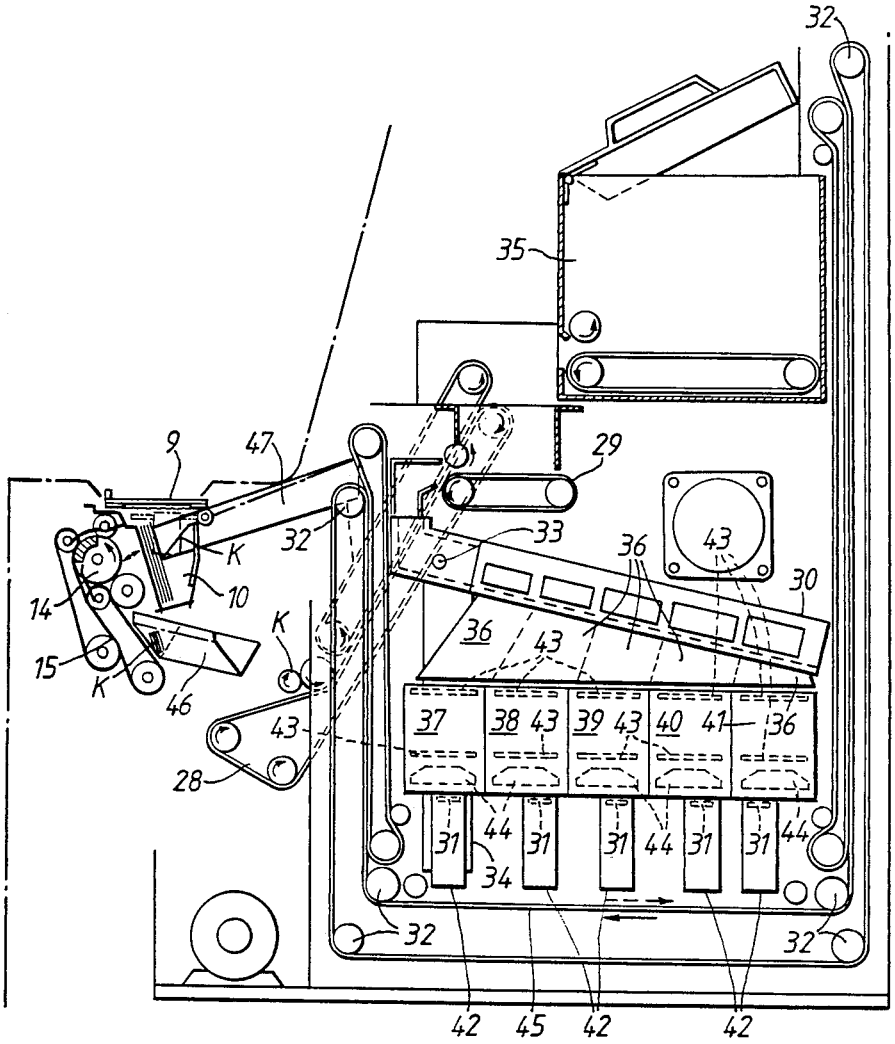
FIG. 3 is a side view showing the construction of the interior of the coin sorting unit housed in the cash handling machine.

FIG. 3 shows the construction of coin circulating unit 5. A coin elevator belt 28, used as a coin conveying means, receives coins K discharged from a depositing chute 46, described below, moving these coins upwards. A receiving belt 29 is installed below the top end of coin elevator belt 28. A coin selector 30 is located below receiving belt 29, in an inclined position. In coin selector unit 30, 1 cent, 10 cent, 5 cent, 25 cent and 50 cent coins are discharged in turn through holes of corresponding dimensions (not shown) and pass via ducts 36 into corresponding storage bins, a 10 cent storage bin 37, a 1 cent storage bin 38, a 5 cent storage bin 39, a 25 cent storage bin 40 and a 50 cent storage bin 41. The amounts of coins K received by storage bins 37–41 are established by a monitoring means 43 and coin take out mechanisms 44 are provided.

Withdrawing ducts 42 are installed which communicate with the bottom faces of storage bins 37–41, and contain counters 31. A discharging belt 45 is installed below ducts 42 and passes over a plurality of rollers 32. A detector 33 is installed at the inlet side of coin selector 30. Any coin found to be incorrect by detector 33 passes via a discharging duct 34 to discharging belt 45 and is discharged. Such incorrect coins pass into a reject storage bin 35 by running discharging belt 45 in the reverse direction indicated by the broken arrow.

Figure 4:
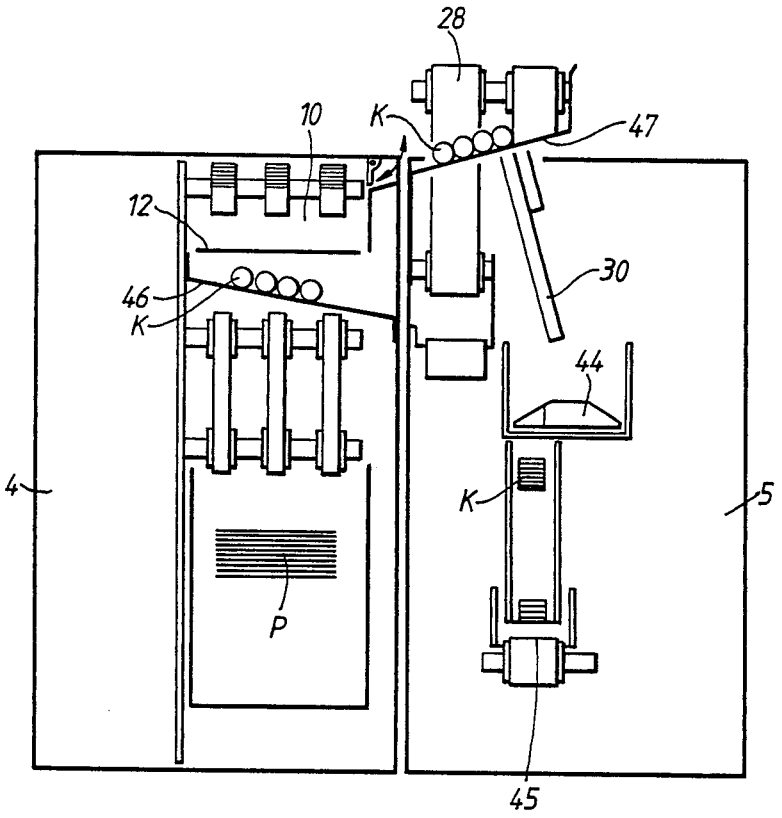
FIG. 4 is a schematic elevation showing the connecting state of the bank note and coin sorting units.

As shown in FIG. 4, cash receiving hopper 10 installed at the side of bank note depositing/withdrawing unit 4, and coin elevator belt 28 installed at the side of coin circulating unit 5, are connected via depositing chute 46 inclined downwards in the direction of coin circulating unit 5 and serving as a feeding means. The discharging side of discharging belt 45 and the rear of receiving hopper 10 are connected via a withdrawing chute 47 which is inclined downwards towards bank note depositing/withdrawing unit 4.

Figure 5:
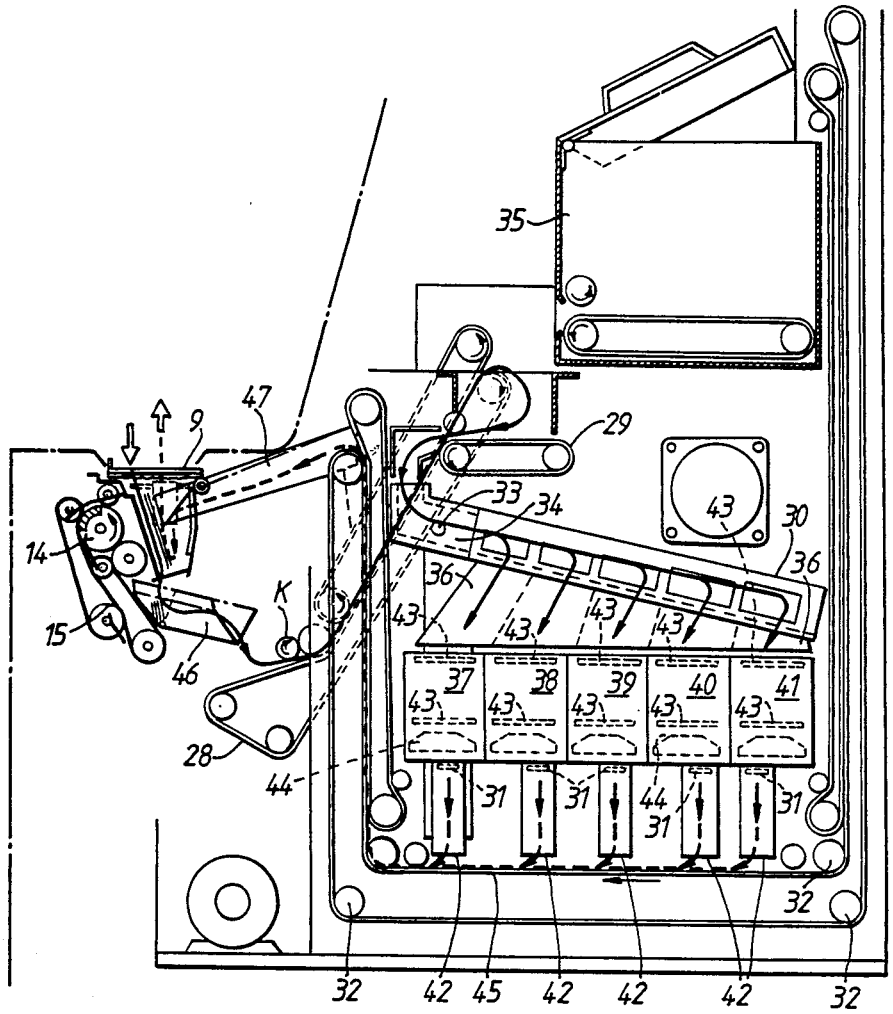
FIG. 5 is a side view showing the flow of coins during paying out and insertion of coins.
Figure 6:
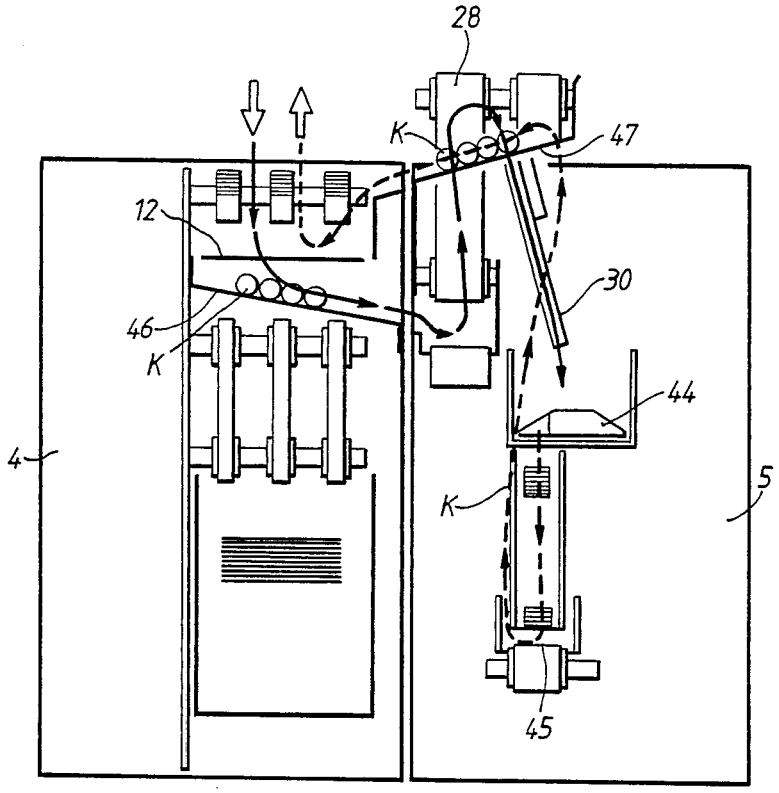
FIG. 6 is a schematic elevation showing the flow of coins in the paying in and paying out chute portions.

When coins K are deposited, shutter 9 is opened and coins passed into cash receiving hopper 10. Having been collected and stopped on bottom plate 12, coins K are caused to drop into depositing chute 46 by opening bottom plate 12. Then coins K slide down to coin elevator belt 28 under their own weight in the direction indicated by the solid arrows in FIG. 6. Movement of coin elevator belt 28 then causes coins K to be raised as indicated by the solid arrows in FIG. 5 and discharged from it at its top position. Coins dropping from coin elevator belt 28 arrive on receiving belt 29 which in turn transports them to coin selector 30. Coins passing through coin selector 30 pass through holes corresponding to the coin dimensions and drop through ducts 36 into corresponding coin storage bins 37–41, in this manner being sorted.

When withdrawing takes place, coins K are removed from money storage bins 37–41 by coin take out mechanisms 44, dropping via withdrawing ducts 42 onto discharging belt 45. Movement of discharging belt 45 in the direction indicated by the broken arrows causes coins K to be transferred on withdrawing chute 47. Then coins K are discharged into cash receiving hopper 10 under their own weight. The customer is then able to open shutter 9.

As described above, bank notes P and coins K are both introduced into the machine via aperture 2. Bank notes P are fed to bank note conveying means 15 and coins K are fed to coin elevator belt 28 as the coin conveying means so that coins cannot be fed to the bank note conveying means thus reliably avoiding any possible damage to it or to internal components.

Another embodiment of the present invention will be described hereinafter with reference to FIG. 7.

An aperture 51 for introducing both coins and bank notes is provided in an upper surface of an operation unit 52. At a position corresponding to aperture 51 there is a cash receiving hopper 53 which receives the mixture of bank notes P and coins K introduced into the machine. Bank notes P are conveyed upwards via a bank note take-in means 54 while coins K are discharged downward via a coin discharging portion 55 to a cash take-in unit 56. When bank notes P and coins K are introduced into the machine, and when bank notes P are discharged, a cash receiving aperture 51 is open, though it is normally closed by a shutter device 57.

Figure 9:
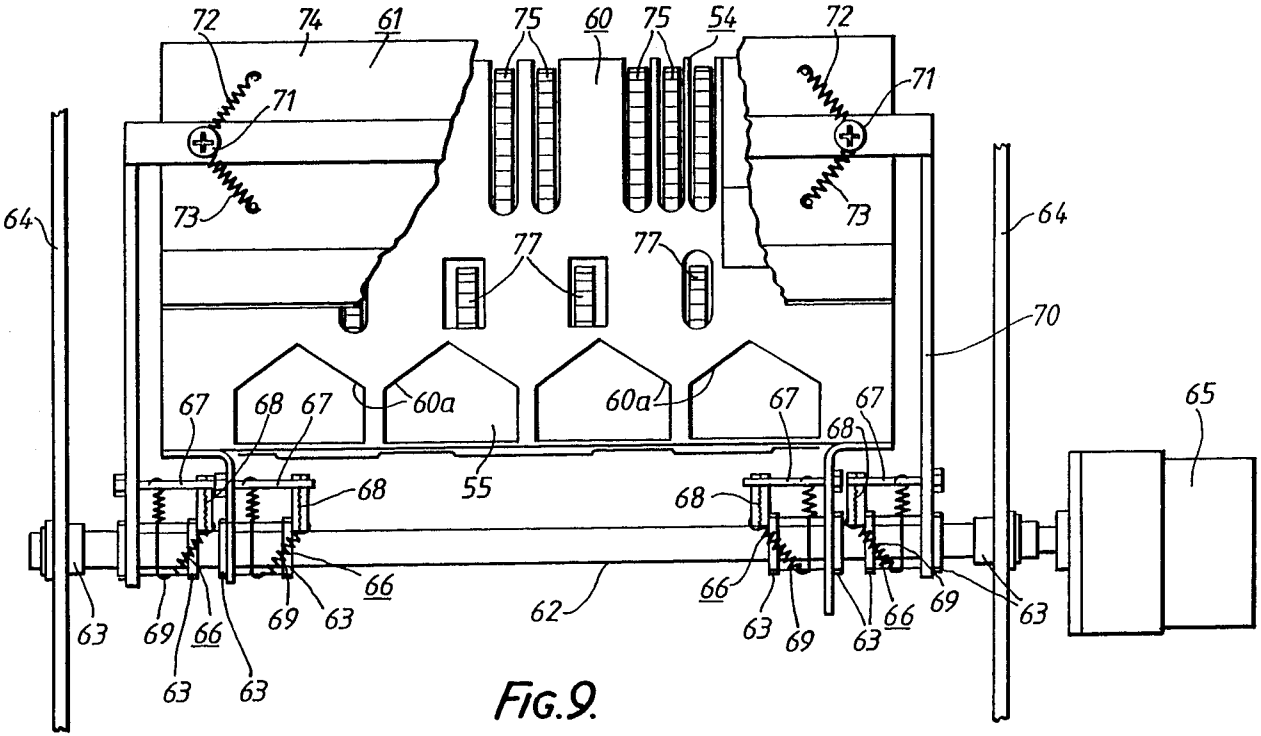

Cash take-in unit 56 is constructed as follows. A supporting plate 60 and a backup member 61 are arranged on juxtaposed faces and form a cash receiving hopper 53. Supporting plate 60 is in the shape of the letter 'L' forming the front and bottom of cash receiving hopper 53 and, as shown in FIG. 9, is provided in the lower portion of its front (vertical) part with openings **60*a* which serve as coin discharging portion 55**.

Supporting plate 60 and backup member 61 are supported on a shaft 62 via oil-containing bearings 63, in such a way as to be capable of free rotation. Shaft 62, in turn, is mounted on frames 64 and 64, also via oil-containing bearings 63, rendering it capable of free rotation. One end of shaft 62 is connected to a pulse motor 65, serving as driving means, which enables it to be rotated in both forward and reverse directions.

The rotational force of shaft 62, caused to rotate in a predetermined direction by pulse motor 65, is transmitted independently to supporting plate 60 and backup member 61 via rotational force transmitting means 66. Rotational force transmitting means 66 comprises follower pins 67 which project at the bottom parts of supporting plate 60 and backup member 61, drive pins 68 in contact with pins 67 and mounted on shaft 62, and coil springs 69, the middle portions of which pass around shaft 62, their ends being connected to pins 67 and 68 respectively, normally biasing pins 67 and 68 into contact with each other.

Therefore, normally, follower pins 67 contact drive pins 68 by the tension force of coil springs 69. Appropriate rotation of shaft 62 creates an adequate receiving space, as shown in FIG. 7, or produces the take-in operation state, as shown in FIG. 8.

Backup member 61 comprises an arm 70 rotatably supported on shaft 62, and a backup plate 74 pivotally mounted on arm 70 via screws 71. Two pair of springs 72, 73 are stretched between screws 71 and backup plate 74, respectively. The tension of springs 72 and 73 are different from each other so that backup plate 74 is capable of swivelling, acting as a bank note pressing member.

Backup plate 74 has a layer of polyurethane foam bonded to the base plate and on top of this a polyester film. A bank note pressing face 74*a* of backup plate 74, which presses against bank notes, assumes the curved shape of feed rollers 75 constituting bank note take-in means 54.

The dimension L of the space between the position of the bottom end of backup plate 74 and supporting plate 60 is greater than the maximum diameter D of coins K, so that coins K cannot push against backup plate 74 even when in an upright position.

Figure 7:
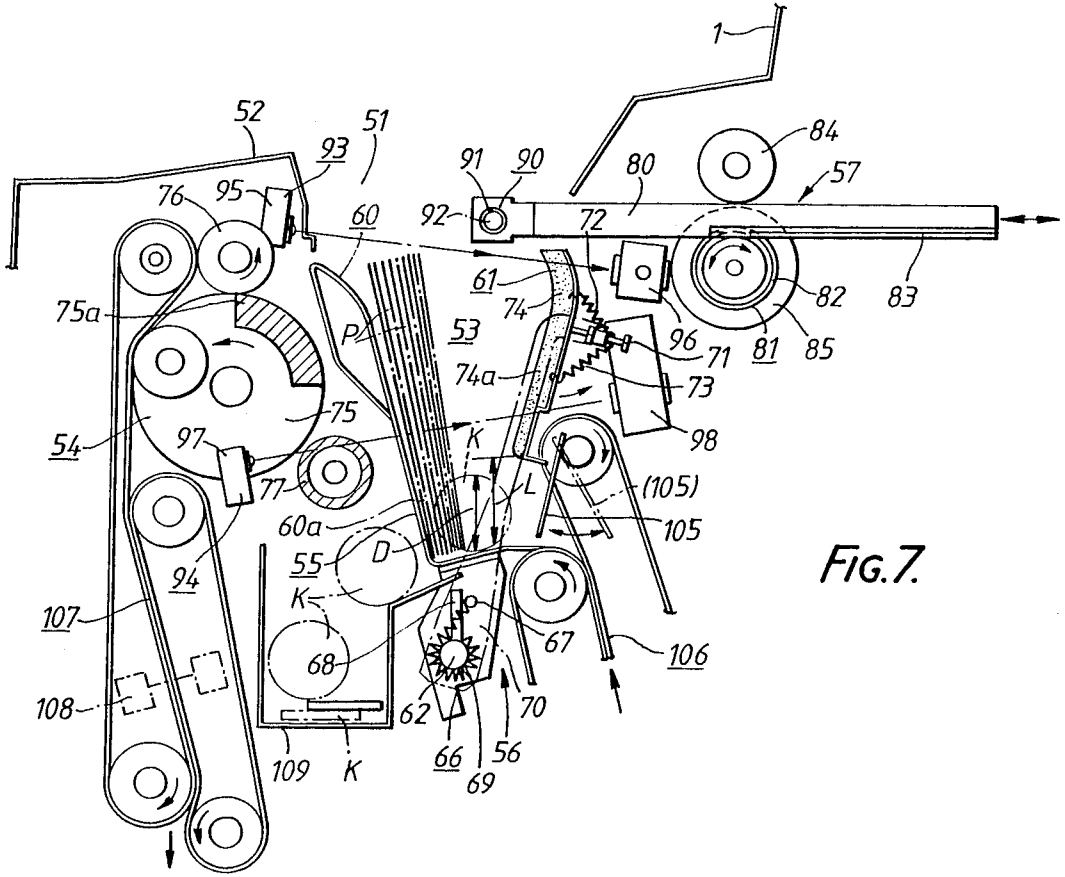
Figure 8:
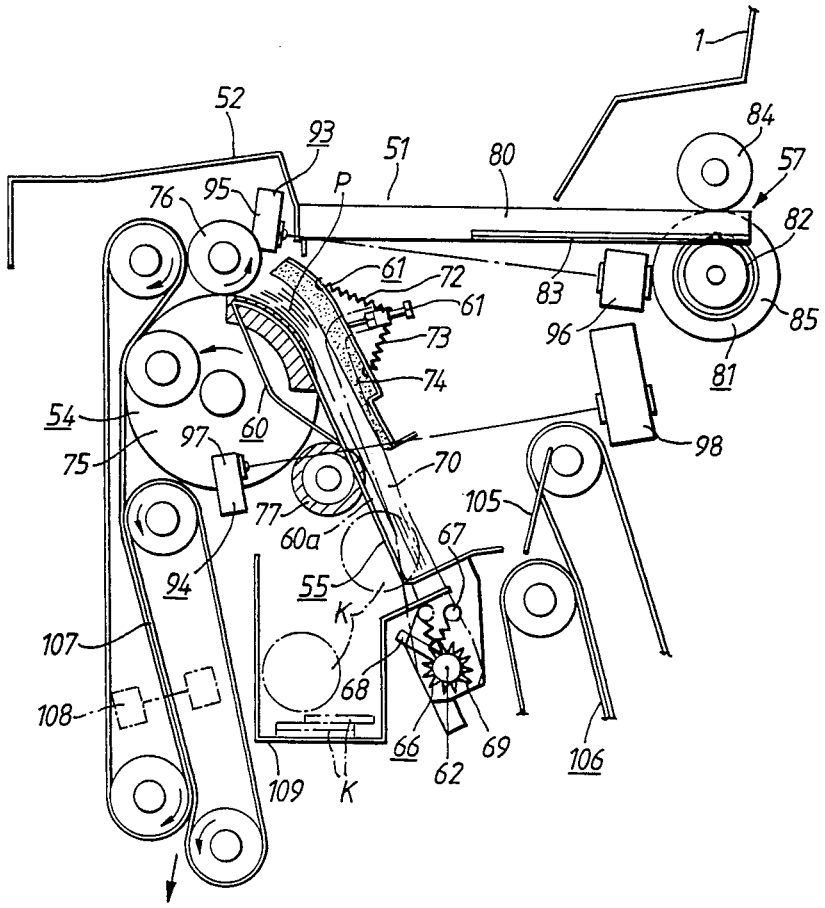

Since the tension of springs 73, extending downwards from screws 71, is greater than that of springs 72, extending upwards from screws 71 on which they are pivotally mounted, backup plate 74 will usually tend to rotate counterclockwise about screws 71, acting as fulcrums, as shown in FIG. 7, but this rotation is controlled by a stopper (not shown), thus maintaining the configuration shown in the drawing.

Feed rollers 75 are provided with rubber tips 75*a*, respectively, having a high coefficient of friction at the portion serving to take-in bank notes, as shown in FIG. 7, leaving an extremely thin gap, for a single bank note P. There are gate rollers 76, rotating at a circumferential velocity 1/10 of that of rollers 75 and in the opposite direction, which prevents taking-in two sheets of bank notes. Gate rollers 76 also have a rubber surface, but the coefficient of friction of this rubber is lower than that of rubber tips 75*a* of rollers 75. Sub-feed rollers 77 are arranged at the bottom of feed rollers 75.

Shutter device 57 which opens/shuts cash receiving aperture 51 will now be explained with reference to FIG. 7. A shutter 80 opens or shuts aperture 51 by the action of a shutter drive means 81. A rack 83 engaging a toothed wheel 82, is installed on the underside of shutter 80. Shutter 80 is held between toothed wheel 82 and a guide roll 84. Rotation of toothed wheel 82 by a pulse motor 85 drives shutter 80, opening or shutting cash receiving aperture 51, depending on the direction of rotation.

Slightly forward of shutter 80 and parallel thereto, a first monitoring device 90 for finger-detecting is installed. It consists of an optical detector comprising a light emitting diode 91 and an optical sensor 92. Being located slightly forward of shutter 80 and in an orthogonal direction to the direction of its displacement, this device is capable of monitoring its whole surface. Thus, when shutter 80 is in its normal position, a signal "no" (no obstacle in the light path) is transmitted, while when shutter 80 is closed or customer's finger inserts, there will be darkness and a signal "yes" (there is an obstacle in the light path) is transmitted.

A second monitoring device 93 is installed at a position slightly above the normal height of bank notes P introduced via aperture 51, serving to monitor this height.

A third monitoring derive 94 is located at a position corresponding approximately to half the normal height of bank notes P (above sub-feed rollers 77), which detects remaining bank notes.

Second monitoring device 93 consists of an optical detector comprising a light-emitting diode 95 and an optical sensor 96. When bank notes P are in a position against the bottom of supporting plate 60, a signal "no presence" is transmitted by device 93.

Third monitoring device 94 consists of two optical detectors comprising two light-emitting diodes 97 and two optical sensors 98. When bank notes P are present in cash receiving hopper 53, a detection signal "presence" is transmitted.

Figure 10:
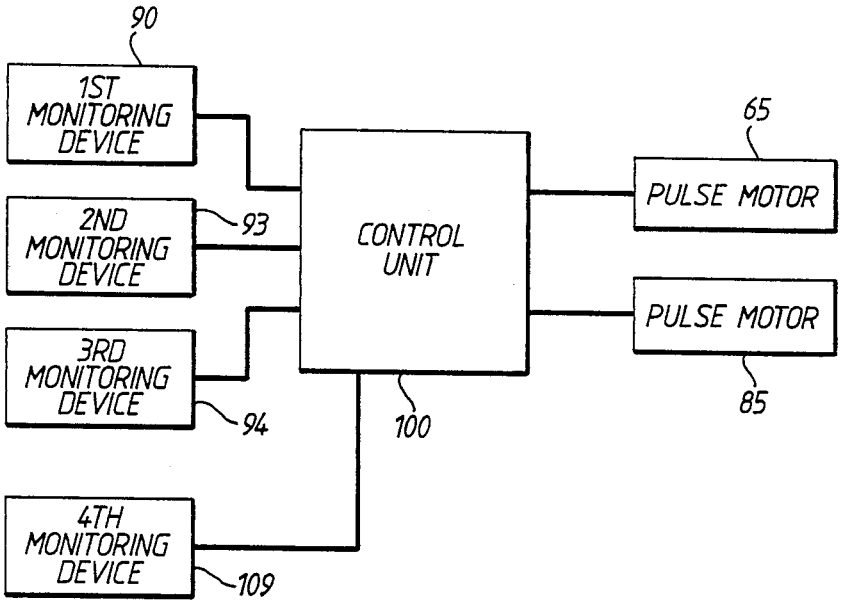

The signals output by monitoring devices 90, 93 and 94 are received by a control unit 100 acting as controlling means, as shown in FIG. 10. This in turn controls the operation of pulse motor 65, driving shaft 62 and of pulse motor 85, driving shutter 80.

Referring now to FIG. 7, when money is withdrawn, a gate 105 rotates to clockwise, to assume the position indicated by the chain-line drawing, enabling bank notes P to be accumulated in cash receiving hopper 53, to be discharged from the withdrawing mechanism (not shown) by opening a bank note discharging conveying path 106. When money is deposited, gate 105 reverts to the position indicated by the solid-line drawing in FIG. 7, closing path 106 and in this manner preventing bank notes P and coins K from entering path 106.

A path 107 serves to convey bank notes P taken in to an inspection unit (not shown) which determines their monetary value. Path 107 includes a fourth monitoring device 108 which detects the positioning of bank notes P. Reference number 109 denotes a coin discharging chute which conveys coins K discharged via coin discharging portion 55 to an inspection unit (not shown) serving to establish the type of coin.

The operations involved in taking in bank notes P and coins K will now be described.

When the cash handling machine is in the operational state, the bank notes P and coins K introducing stage is indicated and shutter 80 opens automatically, as shown in FIG. 7. Under these conditions, an adequate receiving space is formed between supporting plate 60 and backup member 61. The customer then introduces a mixture of bank notes P and coins K into aperture 51, following which shutter 80 closes.

A locking device (not shown) ensures that shutter 80 is completely closed and pulse motor 65 rotates in a predetermined direction, causing shaft 62 to rotate counterclockwise in FIGS. 7 and 8. This first of all causes supporting plate 60 and backup member 61 to swing towards the left by the rotation of shaft 62, transmitted by coil springs 69 of rotational force transmitting means 66. Backup plate 74 of backup member 61 becomes disengaged from the stopper (not shown) and is rotated in an anticlockwise direction about screws 71 acting as fulcrums, since the tension in springs 73 is greater than that in springs 72.

Further swing of supporting plate 60 to the left is prevented by a stopper (not shown) and it assumes a specified positional relationship with feed rollers 75 and sub-feed rollers 77.

Continuing the driving operation of pulse motor 65, shaft 62 continues to rotate, gradually separating pins 67 projected at supporting plate 60, from pins 68 installed on shaft 62, and causing the corresponding coil springs 69 to be wound up.

When the thickness of the bundle of bank notes P in receiving hopper 53 corresponds to a plurality of notes, the upper end of backup plate 74 comes into contact with this bundle, causing it to be bent, assuming the shape of the surface of bank note feed rollers 75. At optimum pressing load, bank notes P are completely pressed against feed rollers 75 and sub-feed rollers 77.

Denoting the bending weight acting on the tip of bank notes P by $F_1$, the optimum pressing load of backup plate 74 by $F_2$, the combined tension exerted by coil springs 72 by $K_1$, the combined tension exerted by coil springs 73 by $K_1'$, and the combined tension exerted by springs 69 by $K_2$, we obtain:

$$K_1' - K_1 > F_1$$

$$K_2 = F_2$$

$$F_2 > F_1$$

and by determining the spring constants of springs 72, 73 and 69, and the displacements, optimum springs can be selected.

Installing these springs 72, 73 and 69 ensures that the top end of backup plate 74 will make satisfactory contact with the top end of bank notes P, bending them over and causing them gradually to rotate clockwise, attaining a state in which their configuration agrees with the curved surfaces of feed rollers 75, as shown in FIG. 8.

When shaft 62 continues to rotate in a counterclockwise direction under these conditions, pins 67 projected at arms 70 of backup member 61, will become separated further from pins 68 mounted on shaft 62, like the corresponding pins of supporting plate 60, causing the corresponding coil springs 69 to become wound up.

At a position at which $K_2$ becomes equal to a given value of $F_2$, rotation of pulse motor 65 stops and this state is then maintained.

With rotation of feed rollers 75, reverse rotation of gate rollers 76 causes bank notes in excess of one to be squeezed, forming a gap capable of accommodating approximately one bank note at a time to be fed through said gap.

As bank notes P present in receiving hopper 53 are taken out, the thickness of the wad decreases gradually and with pulse motor 65 stopped and only the tension exerted by coil springs 69, wound around shaft 62, acting on the system, backup plate 74 also gradually approaches feed rollers 75.

Taking out of bank notes proceeds until no more bank notes are detected by third monitoring device 94.

When a mixture of coins K is introduced into receiving hopper 53, the fact that the bottom end of backup plate 74 is located at a position above the maximum outer diameter of coins K prevents these from pressing directly against it. When mixed with bank notes P, pressure may be exerted via said bank notes, but since sub-feed rollers 77 are located above a level corresponding to the maximum outer diameter D of coins K, they are not drawn up to the position of feed rollers 75.

Since the bottom part of supporting plate 60 is provided with openings **60*a*, serving as coin discharge portion 55, coins K are discharged smoothly via these when supporting plate 60 is inclined or are pushed through openings 60*a* by pressure exerted by bank notes present, and in this manner reliably drop to a discharge chute 109**.

It may occur that bank notes P fail to pass into path 107 despite some remaining bank notes have been detected in receiving hopper 53. Under these conditions, an increase in the pressing force $F_2$ exerted by backup plate 74 will act on these bank notes so that they can be easily taken out.

Thus, in the machine according to the invention, a signal output by fourth monitoring device 108, detecting the take-in state of bank notes P causes pulse motor 65 to continue to drive shaft 62, rotating it to counterclockwise, winding up driving coil springs 69 and thereby increasing the value of $K_2$. This continues until fourth monitoring device 108 begins to detect the flow of bank notes.

However, when $K_2$ has been increased, bank notes P tend to adhere to one another strongly and consequently overlapping bank notes may be taken out. To eliminate this condition, after notes begin to be taken in again, pulse motor 65 rotates shaft 62 in a clockwise direction, causing it to revert to its initial position and in this manner restoring $F_2$ to its optimum value.

When dealing with a roll of new bank notes P being taken in a continuous stream, it may occur that several notes stick together. Fourth monitoring device 108 detects for this condition. Under these conditions the value of $F_2$ should be reduced and this may be achieved by causing shaft 62 to rotate in a clockwise direction by the action of pulse motor 65, in this manner lowering the value of $K_2$.

At all events, in the machine according to the invention, the pressure exerted by backup plate 74 can be selected simply by altering the amount of rotation undergone by shaft 62 and since the dynamic force required for this is provided by pulse motor 65, fine regulation of this pressure is possible.

After the take-in operation has been completed, pulse motor 65 rotates shaft 62 in a clockwise direction, causing wound up coil springs 69 to revert to their initial state, enabling pins 68 mounted on shaft 62 to act on pins 67 projected at supporting plate 60 and backup member 61, respectively, which in turn allows these to revert to their original position.

Furthermore, since shaft 62 which actuates both supporting plate 60 and backup member 61, is located below the bottom portion of supporting plate 60, cash receiving hopper 53, formed between juxtaposed faces of supporting plate 60 and backup member 61, is caused to broaden in an upward direction and to narrow down towards its lower end which constitutes an optimum shape for this receiving hopper.

Since this construction which involves a common shaft 62 is open at the top, it is normally necessary to operate with parallel links and cams, etc., to bring about the main oscillation (swivel motion) of backup plate 74. However, in the machine according to the present invention, this is achieved in a very simple manner by using three types of springs 69, 72, 73 and pivot screws 71, enabling backup plate 74 to be displaced in such a manner as to approximate the curved surface of take-in rollers 75. Furthermore, face 74*a* of backup plate 74 which serves to press against bank notes P is also able to approximate the curved surface of feed rollers 75.

Operation of shutter device 57 will now be described.

Shutter 80 which is closed, opens when bank notes P are introduced. This is brought about by pulse motor 85 driving toothed wheel 82 which engages rack 83, located on the underside of shutter 80, in a clockwise direction as shown in FIGS. 7 and 8.

During this operation, guide roller 84 presses against the top face of shutter 80 and at the same time, rollers of other guiding means (not shown) press against the edges of shutter 80 on both sides, ensuring its smooth movement without wobbling.

First monitoring device 90, located near the front end of shutter 80, is able to monitor fingers inserted in hopper 53 from both sides.

With shutter 80 opened, third monitoring device 94 outputs the signal "presence", first monitoring device 90 outputs the signal "no", and second monitoring device 93 outputs the signal "no presence", indicating that introduction of bank notes P into receiving hopper 53 has been completed. Shutter 80 now immediately closes receiving hopper 53.

When the introduction of bank notes P has not been completed, as for instance when bank notes P are being inserted by hand, the light path of second monitoring device 93 which serves to monitor height, is interrupted by the hand and a signal "presence" is output. Likewise, after the hand has been temporarily taken away, and a finger is then immediately inserted, a signal "yes" is transmitted by first monitoring device 90 since its light path has been interrupted by the finger, before shutter 80 can make contact with the finger.

Furthermore, since the inspecting direction of monitoring devices 90 and 93 are virtually perpendicular to each other, it is possible to detect every hand movement of the customer.

When a "yes" or "presence" signal is transmitted by either monitoring device 90 or device 93 during the shutter 80 closing operation, this operation is immediately stopped and the shutter is opened again by approximately 1 cm, by reverse rotation. This prevents a feeling of uneasiness by the customer resulting when he observes shutter 80 appearing while inserting his fingers into aperture 51 during a depositing or withdrawing operation and is, therefore, an important advantage. As long as the "yes" or "presence" signal persists, the opening operation continues, while when it changes to "no" or "no presence", closing of shutter 80 recommences.

Next, the case in which bank notes P to be withdrawn accumulate in receiving hopper 53 will be described. When accumulation of bank notes is completed, shutter 80 opens.

Since it is essential to receive reliably the accumulated bank notes P by the customer, it is necessary to wait until third monitoring device 94 used to monitor residual bank notes, outputs the signal "no presence".

Thus, in contrast to the depositing operation, closing of shutter 80 only commences when all three monitoring devices 90, 93, and 94 transmit a signal "no", and "no presence". After the closing operation has started provisionally, it is immediately interrupted if any one of the three monitoring devices transmits the signal "yes" or "presence", and shutter 80 re-opens to an extent of approximately 1 cm by reverse rotation of pulse motor 85.

As long as the signal "yes" or "presence" persists, the opening operation continues, but once it is changed to "no" or "no presence", closing recommences.

Thus, inspection by two monitoring means 90, 93 in mutually practically perpendicular directions makes it possible to perform inspection over a broad range. In addition, the use of pulse motor 85 as the driving means makes it possible to achieve instant stopping and rotation in the reverse direction so that a shutter device operating at high speed and with complete safety is obtained.

According to the second embodiment described above, since supporting plate 60 and the backup member 61 provided between juxtaposed faces of cash receiving hopper 53, are rotatably mounted on a single shaft 62, the open space constituting cash receiving aperture 81 can be made sufficiently broad to render the introduction of money easy without requiring a large machine as in the conventional construction in which the supporting plate is independently slidably provided. In addition, a single driving means such as one motor is adequate and it thus become possible to obtain a cheap and highly reliable cash handling machine.

Although only a few embodiments of this invention have been described in detail above, those skilled in the art will readily appreciate that many modifications are possible in the preferred embodiments without departing from the novel teachings and advantages of this invention. Accordingly, all such modifications are intended to be included within the scope of this invention as defined by the following claims.

What is claimed is:

1. A cash handling machine comprising:

a housing having an aperture;

single cash receiving means for receiving both bank notes and coins inserted in said aperture;

bank note feeding means connected to said single cash receiving means for taking out bank notes from said single cash receiving means and for directing said bank notes;

coin feeding means connected to said single cash receiving means for receiving coins from said single cash receiving means and for directing said coins;

bank note conveying means for conveying bank notes directed by said bank note feeding means;

bank note sorting means for sorting bank notes conveyed by said bank note conveying means according to type of bank notes;

coin conveying means for conveying coins directed by said coin feedings means; and coin sorting means for sorting coins conveyed by said coin conveying means according to type of coins.

2. A cash handling machine according to claim 1, wherein said single cash receiving means includes:

supporting means for supporting bank notes inserted through said aperture in a standing state;

backup means, facing said supporting means, for pressing bank notes against said supporting means; and bottom means, movably provided, for supporting the bottom ends of the bank notes and coins put in through said aperture and for discharging the coins to said coin feeding means when said bottom means moves to open a bottom of said single cash receiving means.

3. A cash handling machine according to claim 2, wherein said bank note feeding means includes:

feed roller means, provided behind said supporting means, for contacting the bank notes pressed by said backup means against said supporting means and taking out bank notes from said single cash receiving means in a direction away from said bottom means.

4. A cash handling machine according to claim 1, wherein said coin feeding means includes:

a chute inclined downwards to make coins slide down to said coin conveying means under their own weight.

5. A cash handling machine according to claim 1, wherein said single cash receiving means includes:

supporting means for supporting bank notes inserted through said aperture in a standing state;

backup means facing said supporting means, for defining a cash receiving space with said supporting means and for pressing a part of the bank notes against said supporting means;

a freely rotatable shaft supporting said supporting means and said backup means;

driving means for rotating said shaft in either direction; and rotational force transmitting means for independently transmitting the rotational force of said shaft to said supporting means and said backup means;

whereby said backup means and said supporting means define the cash receiving space therebetween when said driving means rotates said shaft in one direction, and a part of said backup means presses a part of the bank notes against said supporting means to operatively position the pressed part of the bank notes with said bank note feeding means when said driving means rotates said shaft in an opposite direction.

6. A cash handling machine according to claim 5, wherein said bank note feeding means includes:

feed roller means, provided behind said supporting means, for contacting the bank notes pressed by the part of said backup means against said supporting means and taking out the bank notes from said cash receiving space.

7. A cash handling machine according to claim 6, wherein said feed roller means and the bank note pressing part of said backup means are located at a position above the bottom of said cash receiving space corresponding to a maximum outer diameter of the coins and a lower portion of said supporting means is provided with an opening for discharging the coins.

8. A cash handling machine according to claim 5, wherein said backup means includes:

an arm member supported on said shaft;

a backup plate pivotally mounted on said arm member;

a pair of springs with mutually different tensions stretched between said arm member and said backup plate for adjusting a swivelling angle of said backup plate.

9. A cash handling machine according to claim 8, wherein a bank note pressing face of said backup plate has a curved shape corresponding to a curved surface of said bank note feeding means.

10. A cash handling machine according to claim 5, wherein said rotational force transmitting means includes:

follower pins provided on said supporting means and said backup means, respectively;

drive pins provided on said shaft to contact with said follower pins;

spring members, one end of each of which being connected to a corresponding one of said follower pins, respectively, another end of each of which being connected to a corresponding one of said drive pins, respectively, and middle portion of each of which being wound around said shaft.

11. A cash handling machine according to claim 1, wherein said single cash receiving means includes:

shutter means for opening and closing said aperture;

drive means for reciprocably moving said shutter means; and monitoring means for detecting customer's fingers inserted in said single cash receiving means, said drive means being responsive to said first monitoring means to move said shutter to open said aperture when said first monitoring means detects fingers inserted in said single cash receiving means.

12. A cash handling machine according to claim 1, wherein said single cash receiving means includes:

shutter means for opening and closing said aperture;

drive means for reciprocably moving said shutter means; and monitoring means for detecting the height of bank notes being introduced into said single cash receiving means, said drive means being responsive to said second monitoring means to maintain said shutter position to keep said aperture open when said second monitoring means detects that bank notes in said single cash receiving means are resting too high.

* * * * *